US005730249A

United States Patent [19]

Shimizu

[11] Patent Number: 5,730,249

[45] Date of Patent: Mar. 24, 1998

[54] FLUID DISPLACEMENT APPARATUS WITH A LUBRICATING MECHANISM DRIVEN BY A WOBBLE PLATE BALANCING WEIGHT

[75] Inventor: Shigemi Shimizu, Sawa-gun, Japan

[73] Assignee: Sanden Corporation, Gunma, Japan

[21] Appl. No.: 751,420

[22] Filed: Nov. 18, 1996

[30] Foreign Application Priority Data

Nov. 30, 1995 [JP] Japan ..... 7-312728

[51] Int. Cl.[6] ..... F01M 1/06; F01M 9/02

[52] U.S. Cl. ..... 184/6.17; 184/34; 417/269; 92/154

[58] Field of Search ..... 417/269, 222.2, 417/222.1; 184/6.16, 6.17, 32, 34, 35; 91/71, 12.2; 92/154

[56] References Cited

U.S. PATENT DOCUMENTS 5,286,172 2/1994 Taguchi ..... 417/222.2

5,330,335 7/1994 Teracuhi et al. ..... 184/6.16

5,501,579 3/1996 Kimura et al. ..... 417/269

*Primary Examiner*—Timothy Thorpe

*Assistant Examiner*—Samantha H. Moon

*Attorney, Agent, or Firm*—Baker & Botts, L.L.P.

[57] ABSTRACT

A slant plate type compressor includes a compressor housing having a cylinder block provided with a plurality of cylinders and a basin portion formed at a bottom thereof for storing lubricating oil. A slant plate is disposed on the drive shaft and undergoes rotational motion with the drive shaft and is drivingly coupled to the pistons. The rotary motion of the drive shaft is converted into reciprocating motion of the pistons. An annular balance weight is coupled to a wobble plate, which is disposed about the slam plate and includes an axial end surface which has a sloped cross section. A pump mechanism disposed in the housing provides lubricating oil from the oil basin to the drive shaft. The pump mechanism contacts and is powered by the annular balance weight.

12 Claims, 4 Drawing Sheets

FLUID DISPLACEMENT APPARATUS WITH A LUBRICATING MECHANISM DRIVEN BY A WOBBLE PLATE BALANCING WEIGHT

BACKGROUND OF THE INVENTION

1. Field of the Invention

The present invention generally relates to a refrigerant fluid displacement apparatus, and more particularly, to a lubricating mechanism for a slant plate type compressor, such as a wobble plate type compressor with variable capacity mechanism for use in an automotive air conditioning system.

2. Description of the Prior Art

In a compressor, such as a slant plate piston-type refrigerant compressor, lubrication for the driving mechanism is generally supplied by blow-by gas, which in mixed with lubricating oil in a mist state. The blow-by gas is typically leaked from the piston chamber (i.e., compression side of the piston) to the crank chamber through a gap between the outer peripheral surface of the piston and the inner surface of the respective cylinder bores during the compression process. The lubricating oil in the crank chamber naturally lubricates the drive shaft and the parts supporting the drive shaft.

Further, in a compressor having a variable capacity mechanism, such as that shown in U.S. Pat. No. 5,501,579 issued to Kimura et al., the compressor volume may be changed by changing the angle of inclination of the cam rotor. The capacity of the compressor may be adjusted to maintain a constant pressure in the suction chamber in response to changes in the heat load of the evaporator or changes in the rotating speed of the compressor. Capacity control is affected by a valve control mechanism which controls communication between the suction chamber and the crank chamber. The capacity of the compressor is adjusted by changing the angle of the slant plate with respect to a plane perpendicular to the axis of the drive shaft. This angle is dependent upon the crank chamber pressure. An increase in crank chamber pressure decreases the slant angle of the slant plate and the wobble plate, decreasing the capacity of the compressor. A decrease in the crank chamber pressure increases the angle of the slant plate and wobble plate and thus increases the capacity of the compressor. The variable capacity mechanism acts in response to the crank chamber pressure to control the communication link between the crank and suction chambers.

When the slant plate reaches minimum or zero slant angle, i.e., the piston ceases compressing fluid, an urging mechanism, such as return spring, urges the slant plate to increase its slant angle. Accordingly, when the capacity of the compressor decreases, the piston stroke length decreases. The amount of the blow-by gas introduced into the crank chamber in turn decreases, because the pressure differential between the discharge chamber and crank chamber decreases. During the reduced capacity operational state, insufficient lubricating oil is sent to the crank chamber. Consequently, abnormal wearing or seizure of the driving mechanism may occur. Further, the seal mechanism may fail.

These and other disadvantages are sought to be overcome by the compressor according to the preferred embodiments.

SUMMARY OF THE INVENTION

It is an object of the present invention to provide a fluid displacement apparatus with a lubricating mechanism which provides sufficient lubricating oil to a driving mechanism.

It is a further object of the present invention to provide a fluid displacement apparatus with a lubricating mechanism which prevents abnormal wear of and damage to the driving mechanism.

According to the present invention, a slant plate type compressor includes a compressor housing having a cylinder block provided with a plurality of cylinders and basin portion formed at the bottom of the housing for storing lubricating oil. A front end plate is disposed on one end of the cylinder block and encloses a crank chamber between the cylinder block and front end plate. A rear end plate is disposed on the opposite end of the cylinder block from the front end plate. A suction chamber and a discharge chamber are formed in the rear end plate.

A piston is slidably fitted within each of the cylinders. A drive shaft is rotatably supported in the compressor housing. A coupling mechanism drivingly couples the pistons with the drive shaft such that rotary motion of the drive shaft is converted into reciprocating motion of the pistons. The coupling mechanism includes a slant plate disposed on the drive shaft. The slant plate rotates with the drive shaft and has a surface disposed at slant angle relative to a plane perpendicular to the drive shaft. A wobble plate is disposed about a boss of the slant plate. An annular balance weight is disposed about and is coupled to the boss of the slant plate so that the wobble plate is disposed between the slant plate and the annular balance weight. The annular balance weight includes an axial end surface which has a sloped cross section inclined with respect to an axial surface of the wobble plate. The rotary motion of the drive shaft and the slant plate cause the wobble plate to rotate and thereby reciprocate the pistons. A pump mechanism is disposed in the cylinder block. The rotary motion of the axial and surface of the annular balance weight causes the pump to reciprocate and displace oil from the basin for delivery to the rotating parts.

Further object, features and other aspects of this invention will be understood from the following detailed description of the preferred embodiments of this invention with reference to the annexed drawings.

DETAILED DESCRIPTION OF THE PREFERRED EMBODIMENTS

Figure 1:
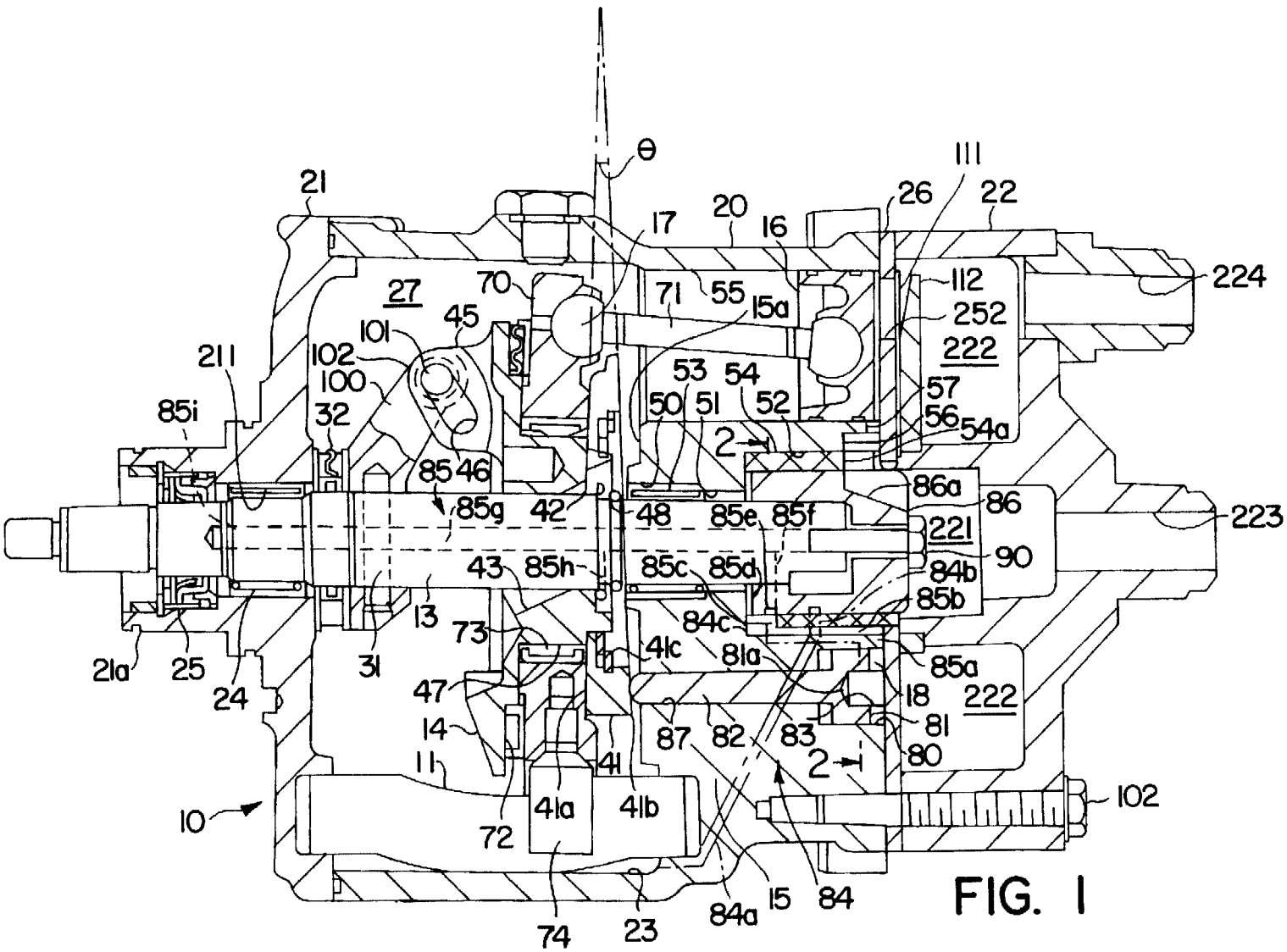
FIG. 1 is a vertical longitudinal sectional view of a slant plate type refrigerant compressor in accordance with a first preferred embodiment of the present invention.

With reference to FIG. 1, the construction of slant plate type compressor in accordance with the present invention is shown.

Compressor 10 includes cylindrical housing 20, cylinder block 15 formed in housing 20, front end plate 21 covering one end of housing 20, crank chamber 27 formed between cylinder block 15 and front end plate 21, and rear end plate 22 disposed at the opposite end of cylinder block 15. Front end plate 21 is mounted on the forward end of cylinder block 15 to enclose crank chamber 27 therein. Rear end plate 22 is mounted on the rear end of cylinder block 15 by a plurality of bolts 102. Valve plate 26 is sandwiched between rear end plate 22 and cylinder block 15.

Opening 211 is centrally formed in front end plate 21. Drive shaft 13 is supported by bearing 24 disposed in opening 211. Cam rotor 100 is fixed on drive shaft 13 by pin member 31, and rotates with drive shaft 13. Thrust needle bearing 32 is disposed between the axial inner (rear) end surface of front end plate 21 and the forward axial and surface of cam rotor 100. Cam rotor 100 includes arm 102 having pin member 101 extending therefrom. Slant plate 14 is disposed adjacent to cam rotor 100. Slant plate 14 includes arm 45 having slot 46, boss 47 and opening 43 through which drive shaft 13 passes. Cam rotor 100 and slant plate 14 are connected by pin member 101, which is inserted in slot 46 to create a hinged joint. Pin member 101 is slidable within slot 46 to allow adjustment of the angular position of slant plate 14 with respect to the longitudinal axis of drive shaft 13.

Wobble plate 70 is mounted about boss 47 of slant plate 14 through bearing 72 and 73 so that slant plate 14 is rotatable with respect thereto. Rotation motion of slant plate 14 causes nutational motion of wobble plate 70. Fork shaped slider 74 is attached to the outer peripheral end of wobble plate 70 and is slidably mounted on sliding rail 11 extending between front end plate 21 and cylinder block 15. Fork shaped slider 74 prevents rotation of wobble plate 70. Wobble plate 70 reciprocates along rail 11 as cam rotor 100 and slant plate 14 rotate. Cylinder block 15 includes a plurality of peripherally located cylinder chambers 55 in which pistons 16 reciprocate. Each piston 16 is connected to wobble plate 70 at a peripheral location by ball portion 17 formed at one end of connecting rod 71. Nutational motion of wobble plate 70 causes pistons 16 to reciprocate in cylinder chamber 55 to compress refrigerant therein.

Cylinder block 15 includes first bore 50, second bore 51 and third bore 52, all formed at the radial center thereof. First bore 50 extends from the front end of cylinder block 15. Second bore 51 extends from the rear end of first bore 50 and third bore 52 extends from the rear end of second bore 51 to the rear end of cylinder block 15. Needle bearing 53 is disposed in first bore 50 and surrounds drive shaft 13. The inner end portion of drive shaft 13 is rotatably supported by bearing 53. Annular sleeve 54 is disposed in third bore 52. Rotary valve 86 is disposed in third bore 52 and fixed to the rear end of drive shaft 13 by bolt 90.

Rear end plate 22 includes centrally located annular suction chamber 221 and peripherally located discharge chamber 222. Valve plate 26 is located between cylinder block 15 and rear end plate 22. Valve plate 26 includes a plurality of valved discharge ports 252 linking discharge chamber 222 with respective cylinders 55. Discharge valves 111 are located on the cylinder head side of valve plate 26 and open and close the respective discharge ports 252. Each discharge valve 111 has an associated valve guard 112 secured to rear end plate 22. Suction chamber 221 includes inlet port 223 which is connected to an evaporator of the external cooling circuit (not shown). Discharge chamber 222 is provided with outlet port 224 connected to a condenser of the cooling circuit (not shown).

Balance weight ring 41 is disposed on the rear end of boss 47 to provide balance to slant plate 14 under dynamic operating conditions. An annular recessed portion **41*c* is formed at a rearward end of balance weight ring 41. Balance weight ring 41 is held in place by retaining ring 42, which is firmly fixed in recessed portion 41*c*. Balance weight ring 41 has a front surface 41*a* and rear surface 41*b*. Rear surface 41*b* is inclined with respect to front surface 41*a* by angle θ. Bias spring 48 is mounted on intermediate portion of drive shaft 13 and abuts slant plate 14. One end of bias spring 48 is firmly secured to drive shaft 13 by snap ring (not shown) as will be explained more fully below. When not under tension, bias spring 48 does not contact the rear surface of slant plate 14, so long as the slant angle of slant plate 14 is preferably in a range between the maximum slant angle and an intermediate angle, preferably thirty percent of the maximum slant angle. Accordingly, slant plate 14 in urged toward the maximum slant angle by the restoring force of bias spring 48 if the slant angle of slant plate 14 decreases below thirty percent of the maximum slant angle. When the slant angle of slant plate 14** is at its maximum, the compressor operates with maximum displacement.

Cylinder block 15 includes at least one pump mechanism 18 disposed between each cylinder chamber 55. Pump mechanism 18 comprises pump cylinder bore 80, pump piston 81, pump piston rod 82, bias member 83, oil passage system 84, oil suction passage system 85 and rotary valve 86. Pump cylinder bore 80 is formed at the rear end of cylinder block 15 radially outside drive shaft 13. Hole 87 is formed in cylinder block 15 and extends from the front end of cylinder block 15 to the front end of pump cylinder bore 80. Hole 87 has a longitudinal axis parallel to the axis of drive shaft 13, and links crank chamber 27 with pump cylinder 80.

Pump piston 81 and pump piston rod 82 are integrally formed with one another. Pump piston 81 includes recessed portion **81*a* formed at the rear end thereof. Pump piston rod 82 is disposed in hole 87. The front end of pump piston rod 82 contacts the rear surface 41*b* of balance weight ring 41. Bias member 83, e.g., a coil spring, is disposed in and contacts recessed portion 81*a*. Bias member 83 contacts the rear end surface of valve plate 26 as well. Bias member 83 biases pump piston 81 toward crank chamber 27**.

Oil suction passage system 84 delivers oil from oil basin 23, which is formed at the bottom of cylindrical housing assembly 20, to pump cylinder bore 80. Oil suction passage system 84 includes suction passage **84*a*, which is formed in cylinder block 15 and communicates with oil basin 23, and third bore 52. First radial hole 84*b* is formed in sleeve 54 and communicates with the open end of suction passage 84*a*. Annular groove 84*c* in formed on the radial peripheral surface of rotary valve 86, and communicates with first radial hole 84*b***.

Figure 2:
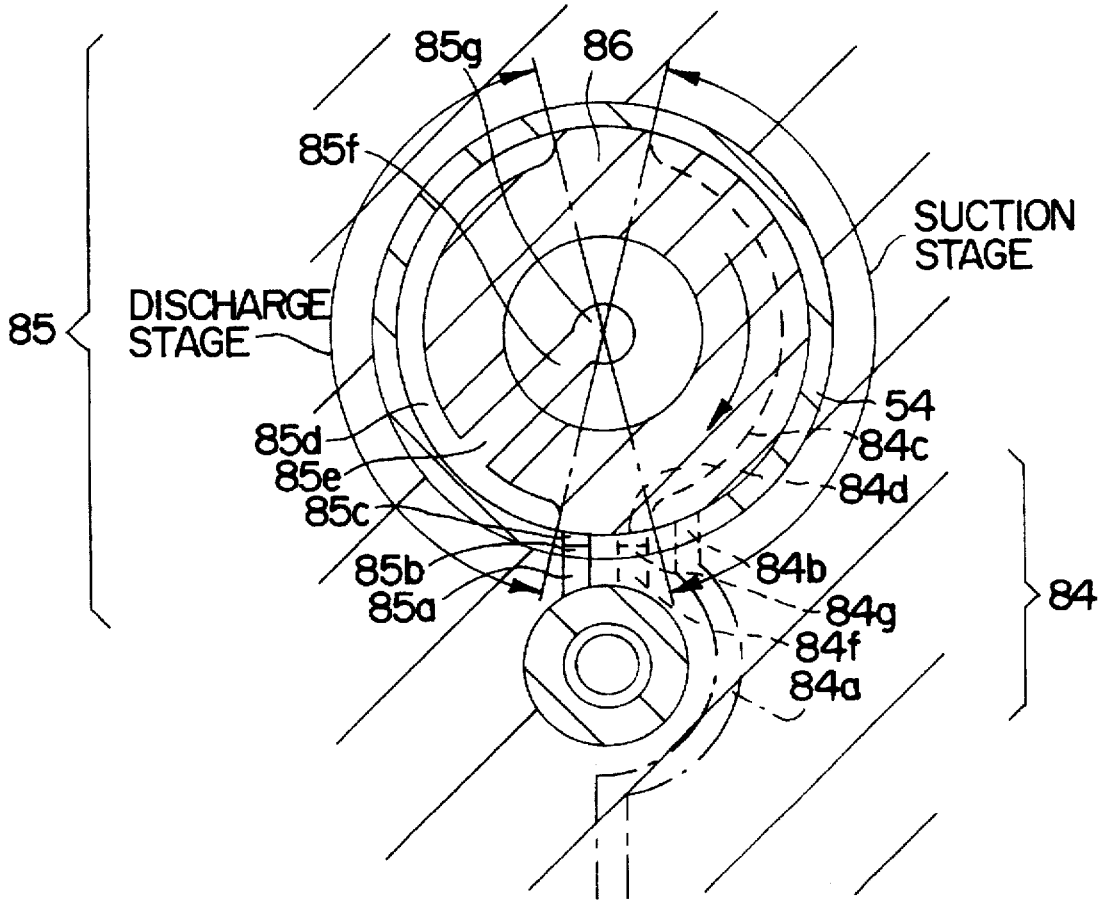
FIG. 2 is an enlarged partial cross sectional view of a lubrication system of a slant plate compressor taken along line 2—2 of FIG. 1.

Referring to FIG. 2, a second radial hole **84*d* is formed on the peripheral surface of sleeve 54. Axial groove 84*e* is formed in the peripheral surface of sleeve 54 and links second radial hole 84*d* with third radial hole 84*f* formed in cylinder block 15**.

Oil delivery passage system 85 includes first radial hole **85*a* formed in cylinder block 15, radial groove 85*b* formed on the peripheral surface of sleeve 54, second radial hole 85*c* formed on the peripheral surface of sleeve 54, annular groove 85*d* formed on the radial peripheral surface of rotary valve 86, third radial hole 85*e* formed in rotary valve 86, fourth radial hole 85*f* formed in drive shaft 13, main oil passage 85*g* formed along the central axis of drive shaft 13, first discharge hole 85*h* (FIG. 1) and second discharge hole 85i radially formed in drive shaft 13**.

First radial hole **85*a* links pump cylinder bore 80 with radial groove 85*b*. Second radial hole 85*c*** links radial groove 85*b* with annular groove 85*d* of rotary valve 86. Annular groove 85*d* links second radial hole 85*c* to forth radial hole 85*f*. Forth radial hole 85*f* is linked with main oil passage 85*g*. Main oil passage 85*g* is linked with first discharge hole 85*h* which is in turn linked with second discharge hole 85*i* formed between needle bearing 24 and sealing mechanism 25.

During operation of the compressor 10, drive shaft 13 is rotated by the engine of the vehicle through electromagnetic clutch (not shown). Cam rotor 100 in rotated with drive shaft 13, rotating slant plate 14 as well, and causing wobble plate 70 to nutate. Nutational motion of wobble plate 70 reciprocates pistons 18 in their respective cylinders 55. As pistons 16 are reciprocated, refrigerant gas, which is introduced into suction chamber 221 through inlet port 223, flows into each cylinder 55 through groove 86*a* in rotary valve 86. Rotary valve 86 is configured so that groove 86*a* is aligned with cylinder 55 during the intake stroke of pistons 16. The compressed refrigerant gas is discharged into discharge chamber 222 from each cylinder 55 through discharge ports 252, and from there into the cooling circuit through outlet port 224.

The capacity of compressor 10 may be adjusted to maintain a constant pressure in suction chamber 221 in response to changes in the heat load of the evaporator, or in response to changes in the rotating speed of the compressor. The capacity of compressor 10 is adjusted by changing the angle of inclination of slant plate 14 with respect to a plane perpendicular to the axis of drive shaft 13. This angle is dependent upon the crank chamber pressure.

An increase in crank chamber pressure decreases the slant angle of slant plate 14 and wobble plate 70, decreasing the capacity of compressor 10. A decrease in the crank chamber pressure increases the angle of slant plate 14 and wobble plate 70 and thus increases the capacity of compressor 10. A variable capacity mechanism preferably acts in response to the crank chamber pressure. The slant angle of slant plate 14 is controlled according to the crank chamber pressure to vary the operating capacity of the compressor. Other types of variable displacement mechanisms, or none at all, may be used in compressor according to the present invention as will be readily appreciated by those skilled in the art.

When the front end surface 41 of balance weight ring 41 is positioned on drive shaft 13, pump piston rod 82 contacts the rear end surface 41*b* of balance weight ring 41*a*. As drive shaft 13 rotates, pump piston 81 is caused to reciprocate. The reciprocation of pump piston causes alternating suctioning and discharging of oil from basin 23. While this occurs, rotary valve 86 opens and closes oil suction passage system 84 and oil providing passage system 85 according to the suction or discharge process of piston 16. Lubricating oil thus flows from oil basin 23, and is directed to the area where drive shaft 13 is slidably supported. More specifically, as rotary valve 86 rotates with drive shaft 13, annular groove 84*c* and annular groove 85*d* of rotary valve rotate along the inner surface of sleeve 54. When annular groove 84*c* is aligned with first radial hole 84*b* and second radial hole 84*d*, lubricating oil within oil basin 23 is introduced into pump cylinder bore 80 by suction motion of pump piston 81. First radial hole 85*a* is at this time closed.

Upon further rotation of drive shaft 13, first radial hole 85*a*, second radial hole 85*c*, radial groove 85*b*, annular groove 85*d*, third radial hole 85*e* and fourth radial hole 85*f* are aligned. Oil then flows through oil passage 85*g*, first discharge hole 85*h* and second discharge hole 85*i*. Needle bearing 24 and shaft seal mechanism 25 are consequently sufficiently lubricated to ensure their reliability and durability throughout the life of the compressor.

According to this embodiment, rotary valve 86 advantageously opens and closes suction ports of cylinders 55 as well as opens and closes the valve of oil suction and providing systems 84 and 85. One end of rotary valve 86 is rotatably disposed in suction chamber 221. Suction groove 86*a* is formed on one end of rotary valve 86. During the suction process, suction groove 86*a* links suction chamber 221 with cylinder bore 55 through opening 54*a* formed in sleeve 54, first opening 56 and second opening 57. During the discharge process, rotary valve 86 closes hole 54*a* and first and second openings 55 and 57, i.e., the peripheral surface of rotary valve 86 slidably contacts hole 54*a* and first and second openings 56 and 57.

Accordingly, even if the angle of slant plate 14 and wobble plate 70 approaches zero degrees, pump mechanism 10 continues to operate and sufficiently provides lubricating oil to the parts supporting drive shaft 13. The preferred embodiment therefore advantageously prevents abnormal wearing or seizure of drive shaft 13, and ensures that shaft seal mechanism 25 is properly lubricated to avoid leakage of refrigerant to the atmosphere.

Figure 3:
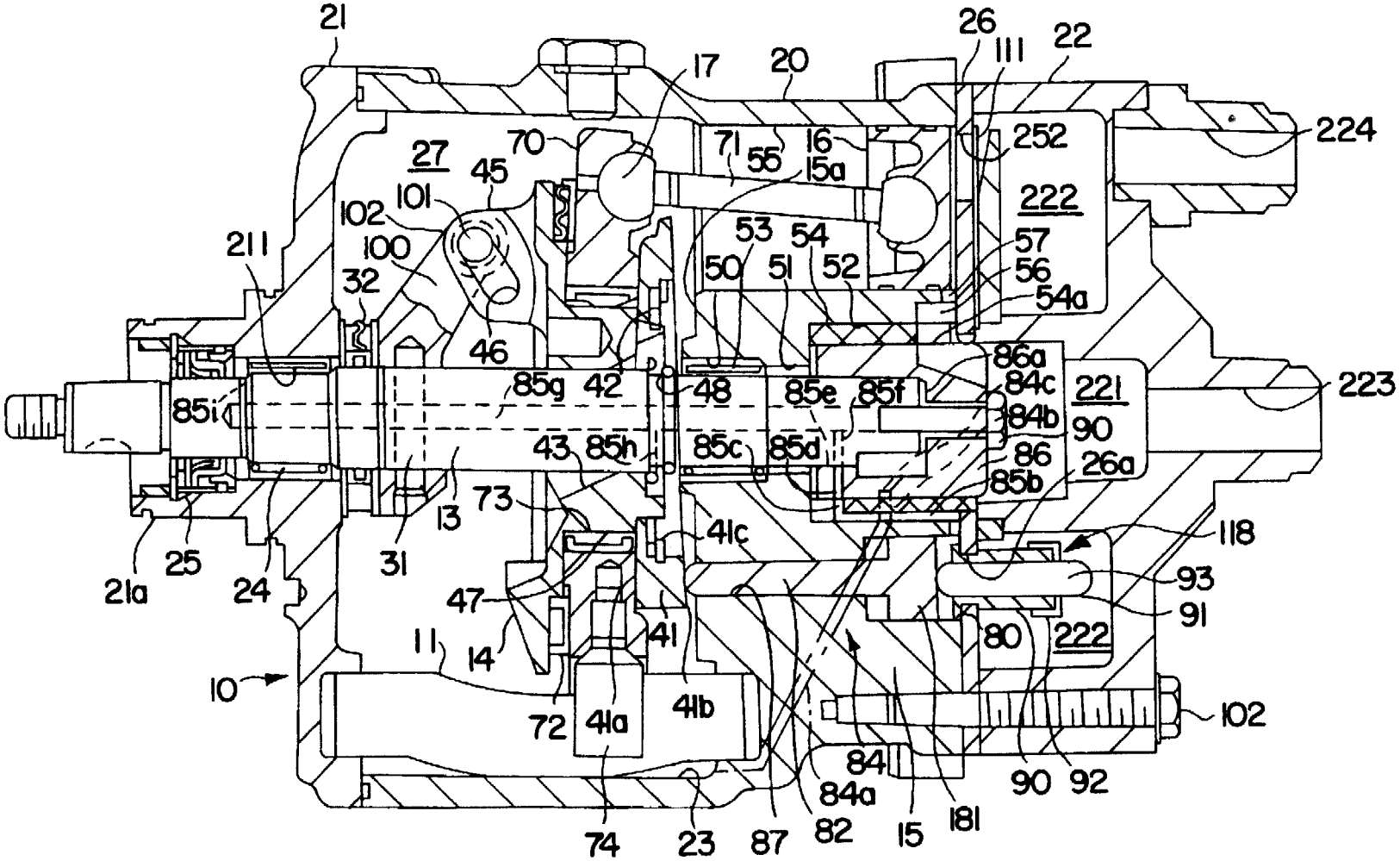
FIG. 3 is a vertical longitudinal sectional view of a slant plate type refrigerant compressor in accordance with a second preferred embodiment of the present invention.

Referring to FIG. 3, a second preferred embodiment of the present invention is shown. The compressor according to this embodiment is similar to the compressor described above, so the discussion will primarily focus on the differences between the embodiments.

Pump mechanism 118 includes pump cylinder bore 80, pump piston 181, pump piston rod 82, rod member 93, sleeve 90, seal member 91 and cap 92. Sleeve 90 is disposed in and secured to opening 26*a*, which is formed in valve plate 26 and links pump cylinder bore 80 with discharge chamber 222. Seal member 91 seals the mating surfaces between sleeve 90 and rod 93. Cap 92 is fixed to the rear end of sleeve 90. Rod 93 is slidably inserted into sleeve 90. One end of rod 93 protrudes into discharge chamber 222, and the other end protrudes into pump cylinder bore 80 to contact the rear end surface 181*a* of pump piston 181. Discharge pressure in discharge chamber 222 urges rod 93 toward crank chamber 27. Consequently, pump piston 181 is constantly urged toward crank chamber 27.

Substantially the same effects and advantages as those in the first embodiment are realized in the second embodiment.

Figure 4:
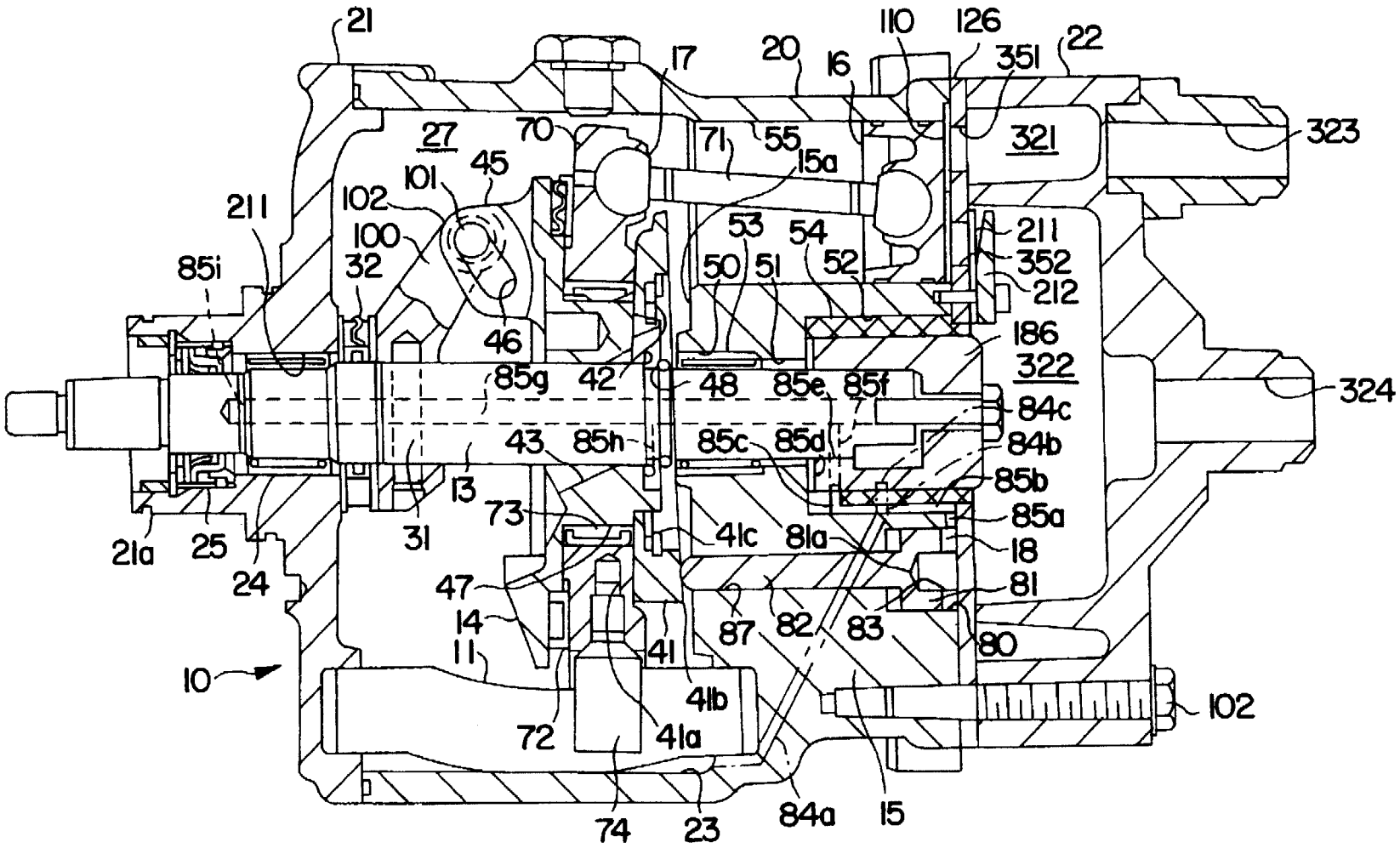
FIG. 4 is a vertical longitudinal sectional view of a slant plate type refrigerant compressor in accordance with a third preferred embodiment of the present invention.

Referring to FIG. 4, a third preferred embodiment of the present invention is shown. The compressor according to the third preferred embodiment is similar to the compressor of the first and second embodiments, so the discussion will primarily focus on the differences.

Rotary valve 186, which is disposed in third bore 52 and fixed to the rear of drive shaft 13 by bolt 90, is formed without the suction groove of the previous embodiments. Rather, the suction and discharge chambers are reversed in the third embodiment, so the need for a rotary valve is eliminated. More specifically, rear end plate 22 includes peripherally located annular suction chamber 321 and centrally located discharge chamber 322. Valve plate 126 includes a plurality of valved discharge ports 352 linking discharge chamber 322 with respective cylinders 55. Discharge valves 211 are provided on the rear side of valve plate 126, and open and close the respective discharge ports 352. Each discharge valve 211 has a valve guard 212 secured to valve plate 126. Suction valve 110 is provided between the rear end of cylinder housing 20 and valve plate 126.

Substantially the same effects and advantages with respect to the lubrication system as those in the first and second embodiments are realized in third embodiment.

The present invention is not limited to wobble plate type compressors with variable displacement mechanisms, but rather is readily adaptable to a fixed capacity wobble plate type compressor. Though the present invention has been described in detail, it should be understood that various changes, substitutions and alterations can be made by those skilled in the art without departing from the sprit and the scope of the present invention as defined by the appended claims.

I claim:

1. A slant plate type compressor comprising:

a compressor housing enclosing a cylinder block having a plurality of cylinders;

means for storing lubricating oil in said compressor housing;

a front end plate disposed on one end of said cylinder block and enclosing a crank chamber between said cylinder block and said front end plate;

a rear end plate disposed on the opposite end of said cylinder block from said front end plate and defining a suction chamber and a discharge chamber;

a piston slidably fitted within each of said cylinders;

a drive shaft rotatably supported in said housing;

coupling means for drivingly coupling said pistons with said drive shaft such that rotary motion of said drive shaft is converted into reciprocating motion of said pistons within said cylinders, said coupling means including a slant plate disposed on said drive shaft and undergoing rotational motion with said drive shaft, said slant plate disposed at slant angle relative to a plane perpendicular to said drive shaft;

a wobble plate disposed about a boss on said slant plate, an annular balance weight coupled to said boss, said annular balance weight including an axial end surface which has a sloped cross section; and a pump mechanism disposed in said housing for providing lubricating oil from said storing means to lubricate said drive shaft, said pump mechanism contacting said annular balance weight.

2. The compressor recited in claim 1, wherein said pump mechanism includes a pump cylinder bore disposed in said cylinder block, a pump piston reciprocatively disposed within said pump cylinder bore to permit said pump piston to reciprocate in said pump cylinder bore, a pump piston rod connected with said pump piston, one end of said pump piston slidably contacting said axial end surface of said annular balance weight, biasing means for biasing said pump piston toward said annular balance weight, a first passage linking said pump cylinder bore with said storing means, a second passage linking said pump cylinder bore with said drive shaft, and a valve mechanism opening and closing said first passage and said second passage according to suction and discharge cycles of said pump piston.

3. The compressor recited in claim 2, wherein said pump mechanism comprises a rotary valve attached to said drive shaft for rotation therewith, said rotary valve including grooves in a peripheral surface thereof so that during rotation of said rotary valve, said pump cylinder bore is intermittently linked to said grooves.

4. The compressor recited in claim 3, wherein said rotary valve includes a passage for introducing suction fluid into each of said cylinders during a suction stroke of said pistons.

5. The compressor recited in claim 2, wherein said biasing means comprises a spring member disposed between said one axial end of said pump piston and said pump cylinder bore.

6. The compressor recited in claim 2, wherein said biasing means is a rod member slidably disposed between said discharge chamber and said pump cylinder bore so as to transmit the force from the discharge pressure acting on said rod member to said pump piston.

7. The compressor recited in claim 1, said coupling means further comprising a cam rotor disposed about said drive shaft, said drive shaft and said cam rotor coupled for rotation, said slant plate hingedly connected to said cam rotor, said hinged connection allowing the slant angle of said slant plate to vary.

8. The compressor recited in claim 7, wherein said pump mechanism includes a pump cylinder bore disposed in said cylinder block, a pump piston reciprocatively disposed within said pump cylinder bore to permit said pump piston to reciprocate in said pump cylinder bore, a pump piston rod connected with said pump piston, one end of said pump piston slidably contacting said axial end surface of said annular balance weight, biasing means for biasing said pump piston toward said annular balance weight, a first passage linking said pump cylinder bore with said storing means, a second passage linking said pump cylinder bore with said area in which said housing slidably supports said drive shaft, and a valve mechanism opening and closing said first passage and said second passage according to suction and discharge cycles of said pump piston.

9. The compressor recited in claim 8, wherein said pump mechanism comprises a rotary valve attached to said drive shaft for rotation therewith, said rotary valve including grooves in a peripheral surface thereof so that during rotation of said rotary valve, said pump cylinder bore is intermittently linked to said grooves.

10. The compressor recited in claim 9, wherein said rotary valve includes a passage for introducing suction fluid into each of said cylinders during a suction stroke of said pistons.

11. The compressor recited in claim 8, wherein said biasing means comprises a spring member disposed between said one axial end of said pump piston and said pump cylinder bore.

12. The compressor recited in claim 8, wherein said biasing means is a rod member slidably disposed between said discharge chamber and said pump cylinder bore so as to transmit the force from the discharge pressure acting on said rod member to said pump piston.

* * * * *